US005877447A

United States Patent [19]

Vice

[11] Patent Number: 5,877,447

[45] Date of Patent: Mar. 2, 1999

[54] COMPENSATION CIRCUIT FOR PIEZOELECTRIC PICKUP

[75] Inventor: Robin D. Vice, Scottsdale, Ariz.

[73] Assignee: Fender Musical Instruments Corporation, Scottsdale, Ariz.

[21] Appl. No.: 843,706

[22] Filed: Apr. 16, 1997

[51] Int. Cl.[6] ..... G10H 1/12; G10H 3/14; G10H 3/18

[52] U.S. Cl. ..... 84/730; 84/731; 84/736; 84/DIG. 9; 84/DIG. 24

[58] Field of Search ..... 84/730–732, 735, 84/736, DIG. 9, DIG. 10, DIG. 24

[56] References Cited

U.S. PATENT DOCUMENTS

| | | | |
|---|---|---|---|
| 3,453,920 | 7/1969 | Scherer | 84/731 |
| 3,493,669 | 2/1970 | Elbrecht et al. | 84/736 |
| 4,399,326 | 8/1983 | Bode | 84/DIG. 9 |
| 4,480,520 | 11/1984 | Gold | 84/735 |
| 5,206,449 | 4/1993 | McClish | 84/731 X |
| 5,268,527 | 12/1993 | Waller | 84/736 |

OTHER PUBLICATIONS

Advertisement by AKG Acoustcs, Inc.; Model 902 De–esser© 1992.

Advertisement by AKG Acoustcs, Inc.; Model 263X De–esser © 1992.

*Primary Examiner*—Stanley J. Witkowski

*Attorney, Agent, or Firm*—Fennemore Craig

[57] ABSTRACT

The signal from a piezo-electric transducer in an electro-acoustic guitar is modified by a variable depth notch filter. The notch filter includes two paths between an input and a summation circuit. The signals in the two paths are 180° out of phase and one of the paths includes a bandpass filter. The notch is located at approximately 5 khz. The depth of the notch depends upon either the broadband amplitude or the narrowband amplitude of the signal from the transducer and the depth of the notch is controlled using either feedback or feedforward control.

16 Claims, 2 Drawing Sheets

COMPENSATION CIRCUIT FOR PIEZOELECTRIC PICKUP

BACKGROUND OF THE INVENTION

This invention relates to electronic musical instruments and, in particular, to electro-acoustic guitars using a piezoelectric element to detect the vibrations of the guitar strings.

Electric guitars can be broadly divided between those having a solid guitar body and those having a hollow body, the latter being constructed essentially identically to an acoustic guitar except for the addition of a transducer to convert the vibrations of the strings into an electrical signal. The transducer in an electro-acoustic guitar is typically a piezoelectric element coupled to the strings at the junction of the strings with the body of the guitar. In a guitar with a solid body, the transducer is typically magnetic and is located near the junction of the strings with the body of the guitar.

Despite some superficial similarities, the two types of guitars serve distinctly different purposes and are actually quite distinct instruments. Generally, one wants the amplifier for an electro-acoustic guitar to reproduce the sounds of an acoustic guitar faithfully. A guitar with a solid body is generally coupled to an amplifier for producing varying kinds and amounts of distortion to the electrical signal from the magnetic transducer. Thus, an electro-acoustic guitar is itself a musical instrument whereas the combination of an electric guitar and an amplifier is the instrument.

A problem with electro-acoustic guitars is the piezoelectric transducer. The amplitude of the electrical signal from the transducer is a non-linear function of stress and frequency. Thus, a passage strummed softly sounds different from the same passage strummed vigorously. For years, musicians have adjusted the gain of amplifiers to match the expected playing level. If a piece included both loud and soft passages, the musician tried to find an intermediate setting that best accommodated both ends of the range. Usually the results were unsatisfactory, with soft passages sounding muffled and loud passages sounding too "bright." Simply providing automatic gain control, with or without high frequency roll-off, has not solved the problem.

It is known in the art to use a variable depth filter for reducing sibilance in audio recording and broadcast. These circuits typically include high frequency roll-off and are known as "de-essing" circuits. Attenuation of high frequencies is typically obtained by inverting or phase shifting 180° the high frequency components and combining the inverted components with the original signal.

In view of the foregoing, it is therefore an object of the invention to provide a compensation circuit for the piezoelectric transducer in an electro-acoustic guitar.

Another object of the invention is to provide a compensation circuit for enabling an amplifier to faithfully reproduce the sound of an acoustic guitar.

A further object of the invention is to eliminate manual tuning or manual adjustment of an amplifier for an electro-acoustic guitar.

SUMMARY OF THE INVENTION

The foregoing objects are achieved in this invention in which it has been found that the signal from a piezo-electric transducer can be corrected with a variable depth notch filter. The notch filter includes two paths between an input and a summation circuit. The signals in the two paths are 180° out of phase and one of the paths includes a bandpass filter. The notch is located at approximately 5 khz. In accordance with one aspect of the invention, the depth of the notch depends upon either the broadband amplitude or the narrowband amplitude of the signal from the transducer. In accordance with another aspect of the invention, the depth of the notch is controlled using either feedback or feedforward control.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
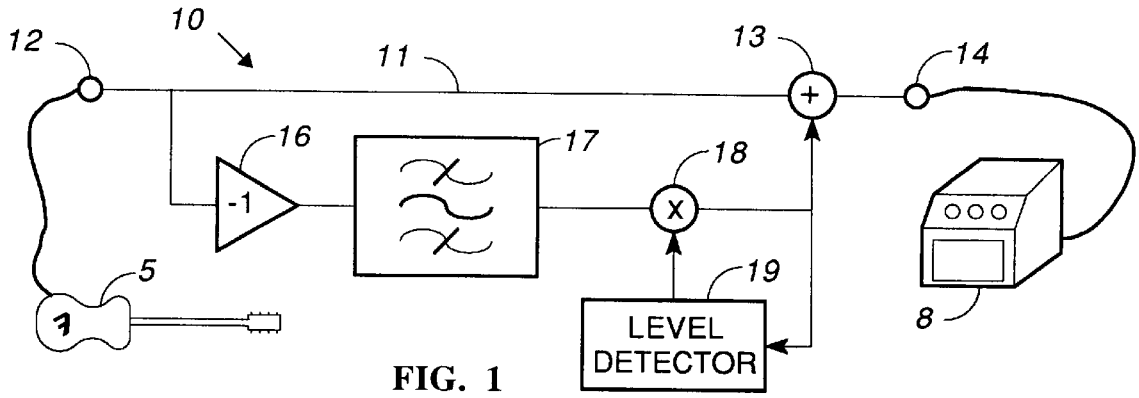
FIG. 1 is a block diagram of a compensation circuit constructed in accordance with a first embodiment of the invention.

FIG. 1 illustrates compensating circuit 10 coupled between electro-acoustic guitar 5 and power amplifier 8. Guitar 5 includes a piezoelectric pickup and a battery powered pre-amplifier. Circuit 10 is coupled to the output of the pre-amplifier. The physical location of circuit 10 is determined by application or convenience. The circuit can be located in guitar 5 or in power amplifier 8, or can be a separate element coupled into the circuit by cables.

Circuit 10 includes direct path 11 between input 12 and summation circuit 13. The output from summation circuit 13 is coupled to output 14. A second path to summation circuit 13 includes inverting amplifier 16, bandpass filter 17, and attenuator 18. Attenuator 18 is a variable gain circuit controlled by the output from level detector 19. In FIG. 1, the input to level detector 19 is taken from the output of attenuator 18 for closed loop or feedback control.

The combination of inverting amplifier, bandpass filter, and summation circuit cooperate to function as a notch filter. Bandpass filter 17 preferably has a pass band centered at approximately 5 khz. Amplifier 16 inverts or phase shifts the input signal 180°, causing circuit 13 to subtract the pass band component from the signal on direct path 11.

Figure 2:
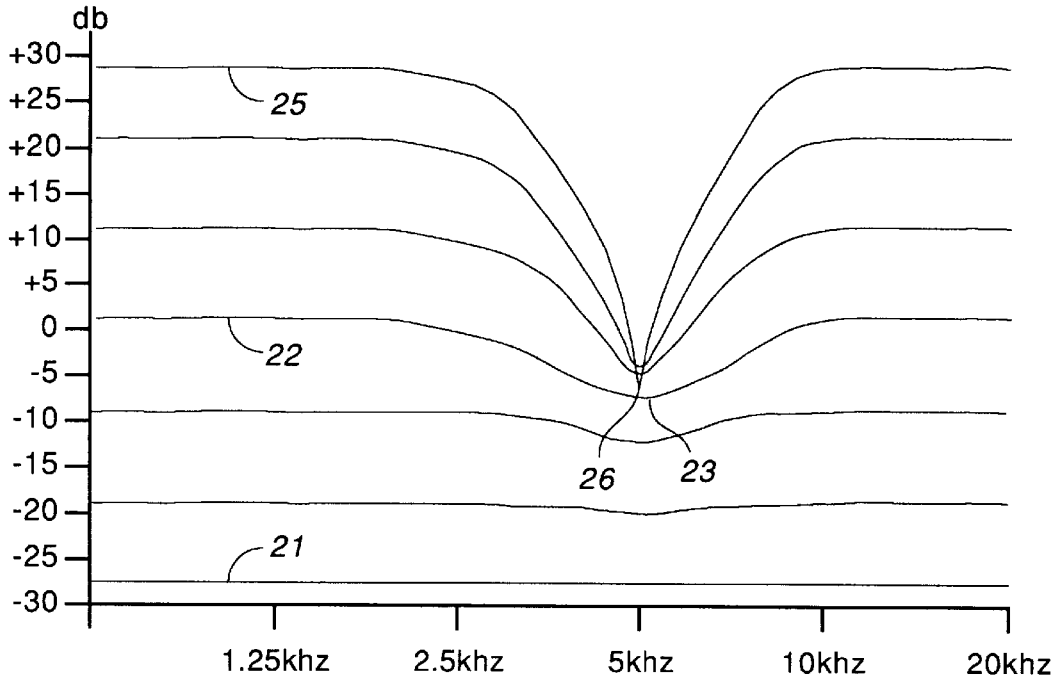
FIG. 2 is a chart illustrating the operation of a compensation circuit constructed in accordance with the invention.

The magnitude of the inverted signal is controlled by level detector 19 and attenuator 18. FIG. 2 is a chart of the frequency response characteristics of circuit 10. An input signal having a low amplitude, e.g. −28 db, is essentially unaffected by the compensating circuit and the response curve of the circuit is flat, as indicated by curve 21. An input signal at zero db. is slightly affected, as indicated by curve 22. At 5 khz., the pass band signal is attenuated by a few db. at point 23 .

A relatively loud input signal, caused by vigorous strumming, is represented by curve 25, which includes notch 26 corresponding to an attenuation of about 30 db. The depth and the center frequency of notch 26 may be adjusted to suit a particular piezoelectric pickup, set of strings, or musical instrument. In an electro-acoustic guitar equipped with a compensating circuit constructed in accordance with the invention, the perception is one of faithful reproduction of the sound of an acoustic guitar at all playing levels. Despite the notch filter, there is no perceived "hole" in the sound from the guitar.

Figure 3:
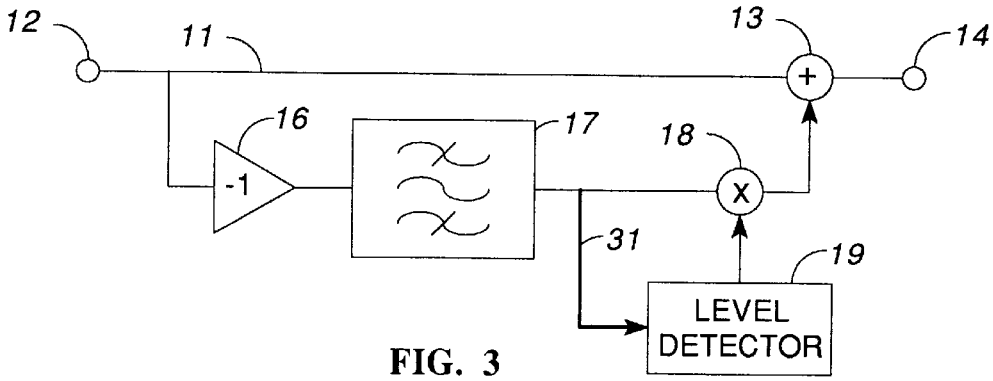
FIG. 3 is a block diagram of a compensation circuit using a feed-forward signal.

FIG. 3 illustrates an alternative embodiment of the invention in which the input to the level detector is taken from the output of the bandpass filter, rather than from the output of the attenuator as in FIG. 1. In FIG. 1, level detector 19 and attenuator 18 form a feedback loop for controlling the magnitude of the filtered signal applied to summation circuit 13. FIG. 3 illustrates a feedforward or open loop control of the depth of the notch.

The output of bandpass filter 17 is coupled to the input of level detector 19 by line 31. In response to the magnitude of the filtered signal, level detector 19 causes attenuator 18 to attenuate the signal from filter 17 less for loud passages than for soft passages. Thus, a larger, inverted signal is applied to summation network 13 and a larger component is subtracted from the original signal, producing a deeper notch.

Figure 4:
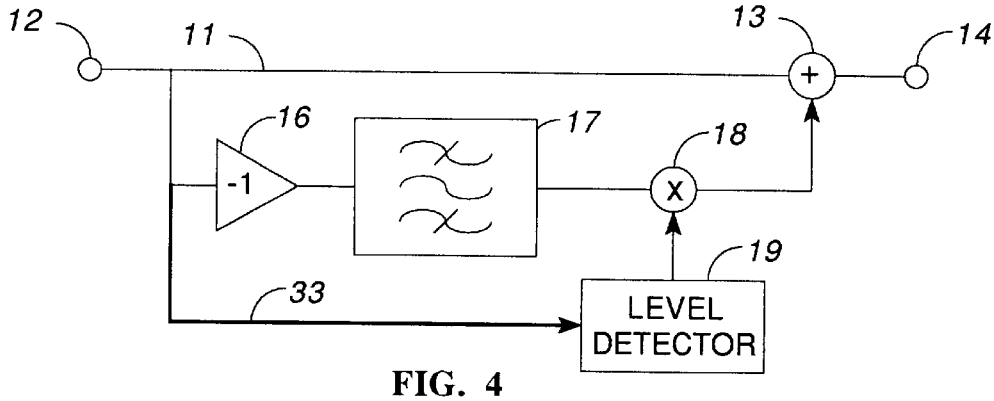
FIG. 4 illustrates an alternative embodiment of the invention using a broadband source for level detection.

FIG. 4 illustrates an alternative embodiment of the invention, also a feedforward design, in which the unfiltered input signal is applied to the level detector for controlling the depth of the notch. Specifically, input 12 is coupled to level detector 19 by line 33. In this embodiment, the magnitude of the broadband signal is used to control the depth of the notch, not just the magnitude of the pass band components as in the embodiment of FIG. 3. Otherwise, the circuit operates in the same manner as the previous embodiments.

Figure 5:
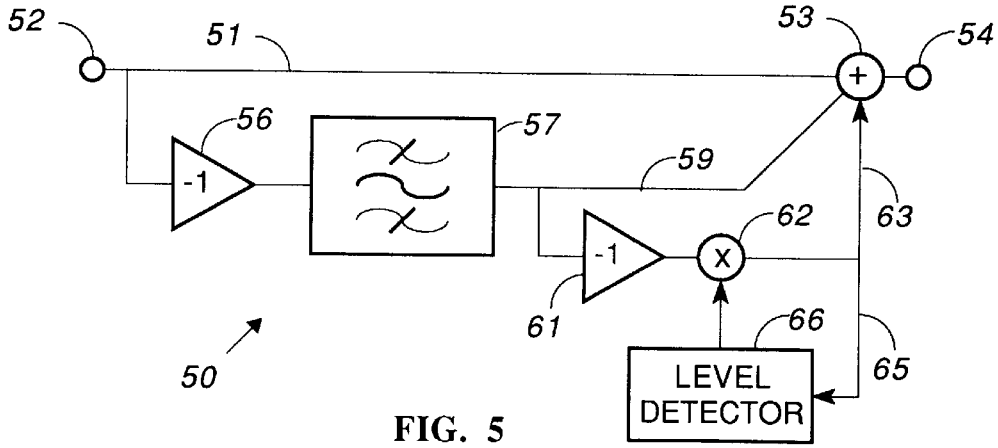
FIG. 5 is a block diagram of a compensation circuit using two inverters to control the depth of a notch filter.

FIG. 5 is a preferred embodiment of the invention in which the original signal and two components are combined to control the depth of the notch. Compensating circuit 50 includes direct path 51 between input 52 and summation circuit 53. The output of summation circuit 53 is coupled to output 54. A second path to summation circuit 53 includes inverting amplifier 56 and bandpass filter 57.

The output of filter 57 is coupled to a second input of summation circuit 53 by line 59 and is coupled to the input of inverting amplifier 61. Amplifier 61 inverts or reverses the phase of the input signal. If amplifier 56 were coupled directly to amplifier 61, the output of amplifier 61 would be essentially identical to the signal on direct path 51. Most amplifiers exhibit some frequency dependent phase shift and a slight phase shift in an amplifier does not adversely affect the compensation circuit. Zero phase shift amplifiers are known in the art and could be used instead but would needlessly increase the cost of the circuit.

The output of amplifier 61 is coupled through attenuator 62 to a third input of summation circuit 53 and is fed back over path 65 to the input of level detector 66, which controls the level of attenuation by attenuator 62. By combining three components, original, anti-phase, and in-phase, the compensating circuit is somewhat easier to implement and provides better control over the signals.

In the absence of a signal on path 63, any pass band component of the original signal is subtracted from the original signal in summation circuit 53 and circuit 50 acts as a notch filter having a deep notch. By adding an adjustable amount of the pass band signal from path 63, the effect of the anti-phase signal on path 59 is reduced in proportion to the amplitude of the pass band component.

Figure 6:
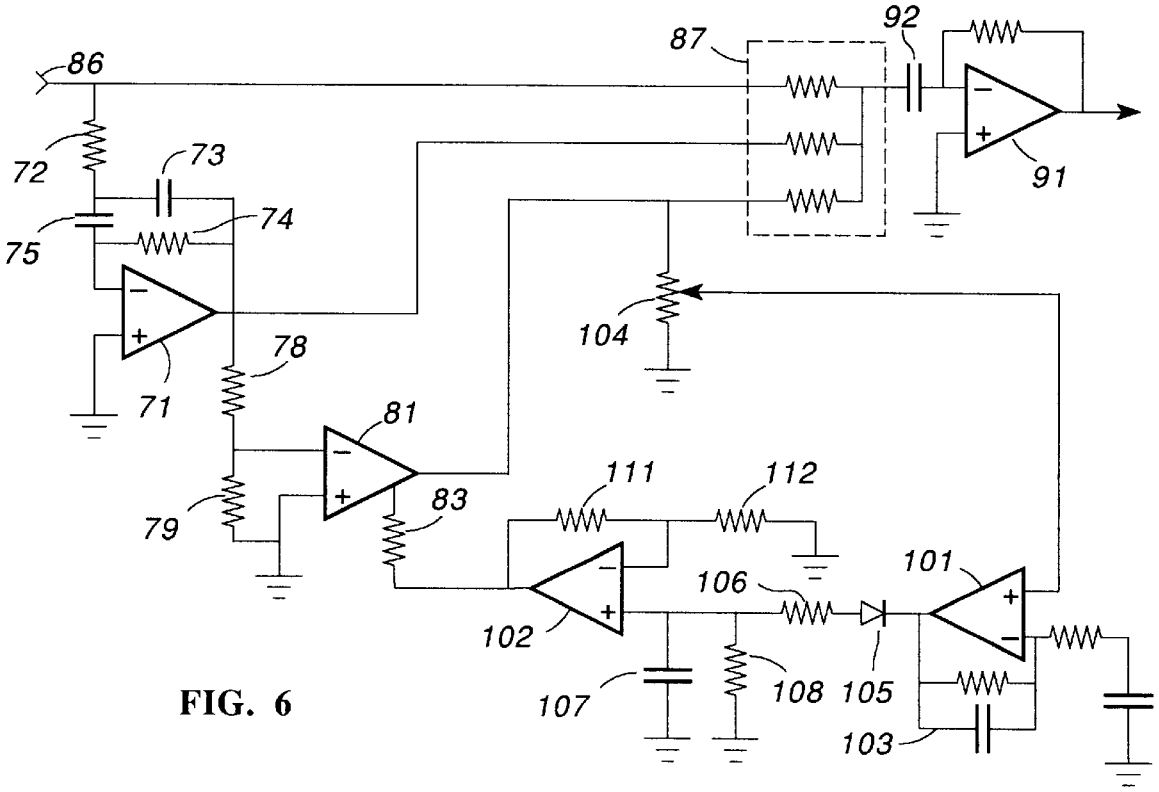
FIG. 6 is a schematic diagram of a compensation circuit constructed in accordance with a preferred embodiment of the invention.

FIG. 6 is a schematic of the compensating circuit illustrated in block form in FIG. 5. Resistor 72, feedback capacitor 73, feedback resistor 74, and capacitor 75 are connected in a bandpass network to the inverting input of amplifier 71. The non-inverting input to amplifier 71 is grounded. The output of amplifier 71 is coupled through a voltage divider including resistors 78 and 79 to the inverting input of variable gain amplifier 81. Resistor 83 couples a gain control signal to amplifier 81.

A signal on input 86 is coupled directly to one of the resistors in summation circuit 87. The output from amplifier 71 is coupled directly to another of the resistors in summation circuit 87 and the output from amplifier 81 is coupled directly to a third resistor in summation circuit 87. The output of summation circuit 87 is coupled to summing amplifier 91 by coupling capacitor 92. Summing amplifier 91 provides the appropriate signals for coupling to a power amplifier.

Amplifiers 101 and 102 provide level detection and gain control. The non-inverting input of amplifier 101 is coupled to the tap on potentiometer 104 for receiving a fraction of the in-phase, filtered signal from amplifier 81. This voltage is compared with the voltage on the inverting input and a difference signal is coupled through diode 105 and isolating resistor 106 to the non-inverting input of amplifier 102. Feedback network 103 controls the gain of amplifier 101 and provides a slight high frequency roll-off to reduce the chance of false triggering due to spurious signals.

Potentiometer 104 enables one to adjust the sensitivity of the gain control circuit. Diode 105 rectifies the output signal from amplifier 101 and charges filter capacitor 107. Resistor 108 provides a high resistance discharge path for the filter capacitor. Resistors 111 and 112 determine the gain of amplifier 102.

When an electro-acoustic guitar is played softly, diode 105 shuts off and amplifier 81 operates at maximum gain, producing a signal equal in magnitude and opposite in phase to the signal from amplifier 71. These in-phase and anti-phase signals cancel each other in summation circuit 87, leaving the original signal unaffected. When the guitar is played vigorously, diode 105 conducts and the gain of amplifier 81 is reduced, thereby increasing the magnitude of the anti-phase, pass band component that is subtracted from the original signal in circuit 87. The result is a pronounced notch in the frequency response of the circuit, as illustrated by curve 25 in FIG. 2.

The invention thus provides a compensation circuit for the piezoelectric transducer in an electro-acoustic guitar and other instruments that use a piezoelectric pickup. The compensation circuit enables an amplifier to faithfully reproduce the sound of an acoustic instrument without the need for manual adjustment during a song.

Having thus described the invention, it will be apparent to those of skill in the art that various modifications can be made within the scope of the invention. For example, as described above, the input to the level detector can be taken from one of several sources. For example, in FIG. 6, potentiometer 104 can be coupled to the output of amplifier 71 or to input 86. The inverter can follow the bandpass filter rather than precede it or be combined with it. In one embodiment of the invention, amplifier 81 was a type CA3080 integrated circuit and the remaining amplifiers were type TL072 integrated circuits. Other devices can be used instead. Potentiometer 104 can be replaced with a pair of resistors in a fixed voltage divider for a circuit that is physically more rugged. Conversely, filter elements in the bandpass filter can be made variable for adjusting the center frequency of the bandpass filter. Although paths 11 and 51 are described as "direct," it is understood that a buffer amplifier could be used in the path. What is intended is that the signals in the direct path and in the path containing the bandpass filter be 180° out of phase. The invention can be used with a piezoelectric pickup in any electronic instrument from which one wants a faithful reproduction of the sound of the instrument.

What is claimed is:

1. A circuit to compensate for a piezoelectric pickup in an electronic musical instrument, said circuit comprising:

an input and an output;

a summation circuit coupled to said output;

a first path between said input and said summation circuit; and a second path between said input and said summation circuit, wherein said second path contains a bandpass filter and the signals in the paths are 180° out of phase to provide a notch filter.

2. The circuit as set forth in claim 1 wherein said second path further includes an inverter for reversing the polarity of a signal applied to said input.

3. The circuit as set forth in claim 2 wherein said second path further includes an attenuator having an output coupled to said summation circuit.

4. The circuit as set forth in claim 3 wherein said attenuator includes a variable gain amplifier.

5. The circuit as set forth in claim 4 and further including a level detector coupled to said variable gain amplifier for reducing the gain of said amplifier when a signal at said input exceeds a predetermined amplitude.

6. The circuit as set forth in claim 5 wherein said level detector includes an input coupled to the output of said attenuator.

7. The circuit as set forth in claim 5 wherein said level detector includes an input coupled to the input of the compensation circuit.

8. The circuit as set forth in claim 5 wherein said level detector includes an input coupled to an output of said bandpass filter.

9. The circuit as set forth in claim 3 wherein said bandpass filter is coupled directly to said summation circuit and is coupled through said attenuator to said summation circuit.

10. The circuit as set forth in claim 9 and further including an inverting amplifier coupled between said bandpass filter and said attenuator.

11. The circuit as set forth in claim 10 wherein said attenuator includes a variable gain amplifier.

12. The circuit as set forth in claim 11 and further including a level detector coupled to said variable gain amplifier for reducing the gain of said amplifier when a signal at said input exceeds a predetermined amplitude.

13. The circuit as set forth in claim 12 wherein said level detector includes an input coupled to the output of said attenuator.

14. The combination comprising:

an electronic musical instrument having a piezoelectric pickup for converting sonic vibrations into an electrical signal;

a variable depth notch filter coupled to said pickup; and a power amplifier coupled to said variable depth notch filter.

15. The combination as set forth in claim 14 wherein said signal has an amplitude within a range between a first level and a second level, wherein said second level is greater than said first level, and wherein said variable depth notch filter includes a level detecting circuit for reducing the depth of the notch when said signal is near said first level.

16. The combination as set forth in claim 14 wherein said electronic musical instrument is an electro-acoustic guitar.

* * * * *